US011594386B2

(12) United States Patent
Gentsch et al.

(10) Patent No.: US 11,594,386 B2
(45) Date of Patent: Feb. 28, 2023

(54) MEDIUM VOLTAGE SWITCHING POLE

(71) Applicant: ABB Schweiz AG, Baden (CH)

(72) Inventors: Dietmar Gentsch, Ratingen (DE); Christian Reuber, Willich (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/351,277

(22) Filed: Jun. 18, 2021

(65) Prior Publication Data

US 2021/0313127 A1 Oct. 7, 2021

Related U.S. Application Data

(63) Continuation of application No. PCT/EP2019/084650, filed on Dec. 11, 2019.

(30) Foreign Application Priority Data

Dec. 20, 2018 (EP) ..... 18214601

(51) Int. Cl.
*H01H 33/66* (2006.01)
*H01H 33/666* (2006.01)
*H01R 41/02* (2006.01)

(52) U.S. Cl.
CPC ..... *H01H 33/6606* (2013.01); *H01H 33/666* (2013.01); *H01R 41/02* (2013.01)

(58) Field of Classification Search
CPC ..... H01H 33/6606; H01H 33/666; H01H 33/6647; H01H 2033/6648; H01H 3/50; H01R 41/02
USPC ..... 218/140, 120, 118, 123, 134, 139, 146, 218/153, 154; 200/252, 253, 258
See application file for complete search history.

(56) References Cited

U.S. PATENT DOCUMENTS 5,055,640 A * 10/1991 Lippi ..... H02B 11/12 218/120
7,115,831 B2 * 10/2006 Chyla ..... H01H 33/6606 218/124
8,592,708 B2 * 11/2013 Hatanaka ..... H02B 13/0655 218/16

(Continued)

FOREIGN PATENT DOCUMENTS

DE 102014205762 A1 10/2015
EP 1583119 A2 10/2005
WO WO 2011107254 A1 9/2011

*Primary Examiner* — William A Bolton
(74) *Attorney, Agent, or Firm* — Leydig, Voit & Mayer, Ltd.

(57) ABSTRACT

A medium voltage switching pole includes: a fixed contact of a vacuum interrupter; a movable contact of the vacuum interrupter; a piston; at least one electrical contact; a first terminal; and a second terminal. The fixed contact is fixedly connected to the first terminal. The movable contact is fixedly connected to the piston. The piston moves within the second terminal along an axis. The at least one electrical contact makes an electrical connection between the piston and the second terminal. An outer surface of the piston and an inner surface of the second terminal are arranged such that: when in an open configuration the fixed contact and movable contact are separated, at least one first radial line perpendicular to the axis extends through locations of the at least one electrical contact, and a first distance along the at least one first radial line extends from the outer surface.

10 Claims, 3 Drawing Sheets

(56) References Cited

U.S. PATENT DOCUMENTS

| | | | | |
|---|---|---|---|---|
| 9,202,645 | B2 | 12/2015 | Berard et al. | |
| 9,238,784 | B2 * | 1/2016 | Sato | C10M 169/02 |
| 9,679,708 | B2 * | 6/2017 | Benson, IV | H01H 3/001 |
| 2011/0266120 | A1 * | 11/2011 | Nakauchi | H01R 13/187 200/252 |
| 2012/0118710 | A1 | 5/2012 | Yang | |
| 2016/0035501 | A1 * | 2/2016 | Nukaga | H01H 1/60 200/252 |

* cited by examiner

MEDIUM VOLTAGE SWITCHING POLE

CROSS-REFERENCE TO PRIOR APPLICATIONS

This application is a continuation of International Patent Application No. PCT/EP2019/084650, filed on Dec. 11, 2019, which claims priority to European Patent Application No. EP 18 214 601.9 filed on Dec. 20, 2018. The entire disclosure of both applications is hereby incorporated by reference herein.

FIELD

The present invention relates to a medium voltage switching pole.

BACKGROUND

Medium voltage (MV) switching poles with spiral contacts or multicontacts are used for the transfer of the current from a fixed side of the switching pole to the movable parts of the switch. In these switching pole systems, a cylindrical piston runs in an arrangement of contact elements that are fixed in an outer hollow cylinder, or the contact elements are fixed onto the movable piston and run inside the hollow cylinder along with the piston.

The contacts generate a certain amount of friction during their operation. This friction can be static friction and dynamic friction. For the safe transfer of current—both nominal rated current and short circuit current—it is required that the contact points of a spiral contact or of a multicontact system are pressed onto the corresponding surfaces with a certain contact force. This contact force has a strong influence on the friction that has to be overcome when the pole is being operated. The result is a requirement for the drive of the pole that can make the drive more complex, larger and/or more expensive.

There is a need to provide for an improved medium voltage switching pole.

SUMMARY

In an embodiment, the present invention provides a medium voltage switching pole, comprising: a fixed contact of a vacuum interrupter; a movable contact of the vacuum interrupter; a piston; at least one electrical contact; a first terminal; and a second terminal, wherein the fixed contact is fixedly connected to the first terminal, wherein the movable contact is fixedly connected to the piston, wherein the piston is configured to move within the second terminal along an axis, wherein the at least one electrical contact is configured to make an electrical connection between the piston and the second terminal, and wherein an outer surface of the piston and an inner surface of the second terminal are configured such that: when in an open configuration the fixed contact and movable contact are separated from one another, at least one first radial line perpendicular to the axis extends through locations of the at least one electrical contact, and a first distance along the at least one first radial line extends from the outer surface of the piston to the inner surface of the second terminal, and when in a closed configuration the fixed contact and movable contact are in contact with one another, at least one second radial line perpendicular to the axis extends through locations of the at least one electrical contact, and a second distance along the at least one second radial line extends from the outer surface of the piston to the inner surface of the second terminal, the first distance being greater than the second distance.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1A:
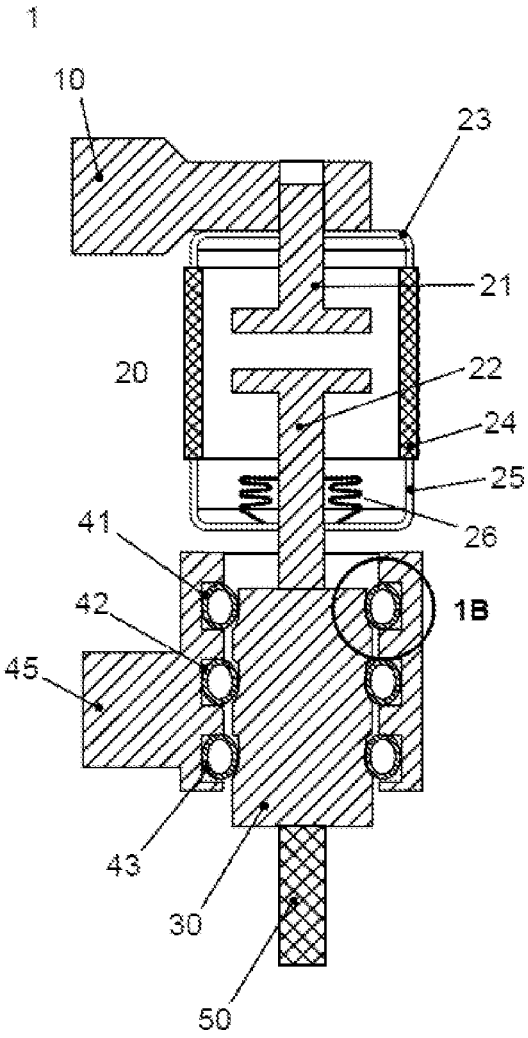
FIG. 1A shows a sectional view of an example of a medium voltage switching pole in an open configuration and FIG. 1B shows a detail view thereof.

In an embodiment, the present invention provides an improved medium voltage switching pole.

In an aspect, there is provided a medium voltage switching pole. The switching pole comprises a fixed contact of a vacuum interrupter, a movable contact of the vacuum interrupter, a piston, at least one electrical contact, a first terminal, and a second terminal. The fixed contact is fixedly connected to the first terminal. The movable contact is fixedly connected to the piston. The piston is configured to move within the second terminal along an axis. The at least one electrical contact is configured to make an electrical connection between the piston and the second terminal. An outer surface of the piston and an inner surface of the second terminal are configured such that:

when in an open configuration the fixed contact and movable contact are separated from one another, wherein at least one first radial line perpendicular to the axis extends through locations of the at least one electrical contact and wherein a first distance along the at least one first radial line extends from the outer surface of the piston to the inner surface of the second terminal; and when in a closed configuration the fixed contact and movable contact are in contact with one another, wherein at least one second radial line perpendicular to the axis extends through locations of the at least one electrical contact and wherein a second distance along the at least one second radial line extends from the outer surface of the piston to the inner surface of the second terminal, and wherein the first distance is greater than the second distance.

In other words, a medium voltage (MV) switching pole is provided with one or more electrical contacts, such as spiral contact or multicontacts, for the transfer of the current from a fixed side of the switching pole to the movable parts of the switching pole. A piston is running in an arrangement of contact elements that are fixed in an outer hollow terminal, or the contact elements are fixed onto the movable piston and are running inside the hollow terminal. However, at the position of the electrical contact the distance between the piston and the hollow terminal is less when the switch is in the closed state than when it is in the open state. Thus, the contact pressure on the electrical contact when in the closed state and when current flows is high enough to ensure a low electrical contact resistance to limit losses and temperature rises when the nominal rated current of the switching pole flows from the first terminal to the second terminal. However, when in the open state when no current can flow the contact pressure on the electrical contact is reduced because there is a greater distance between the walls pushing upon the electrical contact. Thus, the static friction at the start of the closing operation is reduced, resulting in more uniform closing times and more uniform closing speeds, especially when the drive of the pole cannot easily generate high closing forces in the open position, as is the case for example for magnetic actuators.

In an example, when in the open configuration the outer surface of the piston has a first diameter along the at least one first radial line, and when in the closed configuration the outer surface of the piston has a second diameter along the at least one second radial line. The second diameter is greater than the first diameter.

In an example, at one or more first longitudinal positions the outer surface of the piston has a circular cross section with a diameter of the first diameter. At one or more second longitudinal positions the outer surface of the piston has a circular cross section with a diameter of the second diameter.

In an example, in a direction extending away from the second movable contact the outer surface of the piston has a plurality of circular cross sections in transitioning from the outer surface with the first diameter to the outer surface with the second diameter.

In an example, the plurality of cross sections form a cone shaped region.

In an example, the plurality of cross sections form a sinusoidal shaped region.

In an example, in a direction extending away from the second movable contact a transition region joins the outer surface with the second diameter to the outer surface with the first diameter. When transitioning from the closed configuration to the open configuration the piston is configured such that the transition region does not contact the at least one electrical contact.

In an example, the at least one first radial line is at the same axial location as the at least one second radial line.

In an example, the at least one electrical contact is fixed to the inner surface of the second terminal.

In an example, when in the open configuration the inner surface of the second terminal has a first diameter along the at least one first radial line, and when in the closed configuration the inner surface of the second terminal piston has a second diameter along the at least one second radial line. The second diameter is less than the first diameter.

In an example, at one or more first longitudinal positions the inner surface of the second terminal has a circular cross section with a diameter of the first diameter. At one or more second longitudinal positions the inner surface of the second terminal has a circular cross section with a diameter of the second diameter.

In an example, in a direction extending away from the second movable contact the inner surface of the second terminal has a plurality of circular cross sections in transitioning from the inner surface with the first diameter to the inner surface with the second diameter.

In an example, the plurality of cross sections form a cone shaped region.

In an example, the plurality of cross sections form a sinusoidal shaped region.

In an example, in a direction extending away from the second movable contact a transition region joins the inner surface with the second diameter to the inner surface with the first diameter. When transitioning from the closed configuration to the open configuration the second terminal is configured such that the transition region does not contact the at least one electrical contact In an example, the at least one first radial line is at a different axial location to the at least one second radial line.

In an example, the at least one electrical contact is fixed to the outer surface of the piston.

In an example, the at least one electrical contact is elastically deformable.

The above aspects and examples will become apparent from and be elucidated with reference to the embodiments described hereinafter.

Figure 1B:
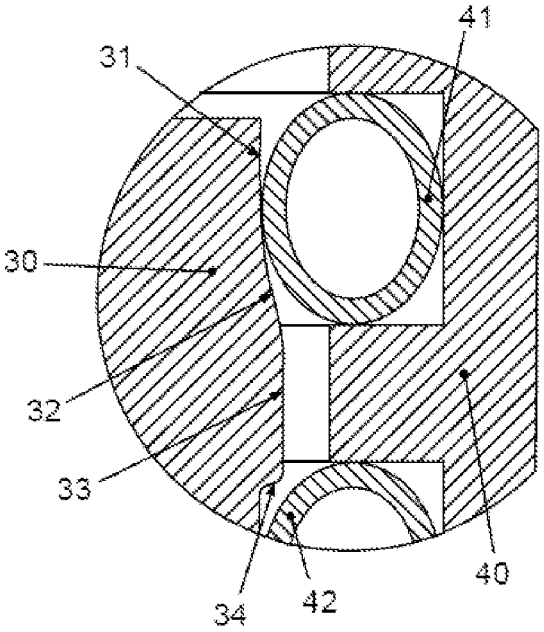
Figure 2A:
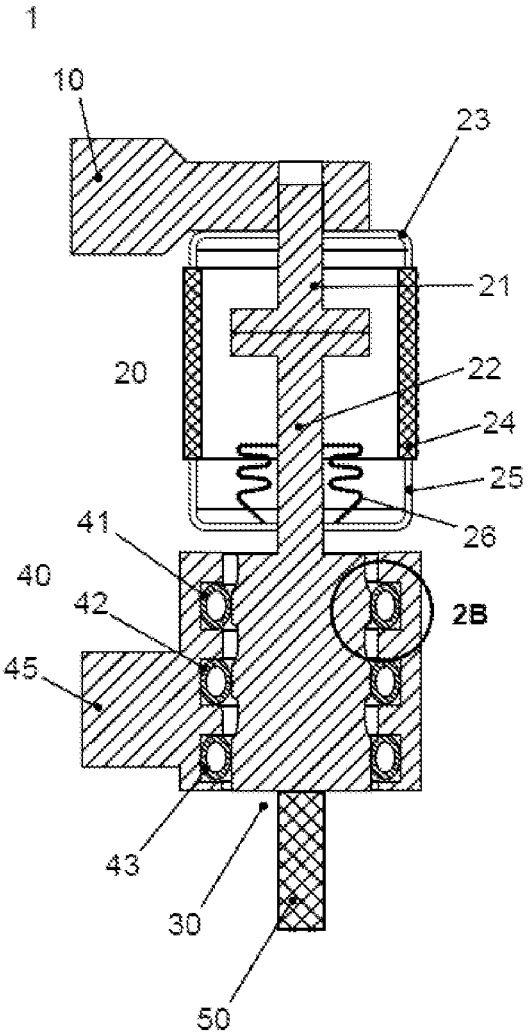
FIG. 2A shows a sectional view of the medium voltage switching pole of FIG. 1 in a closed configuration and FIG. 2B shows a detail view thereof.
Figure 2B:
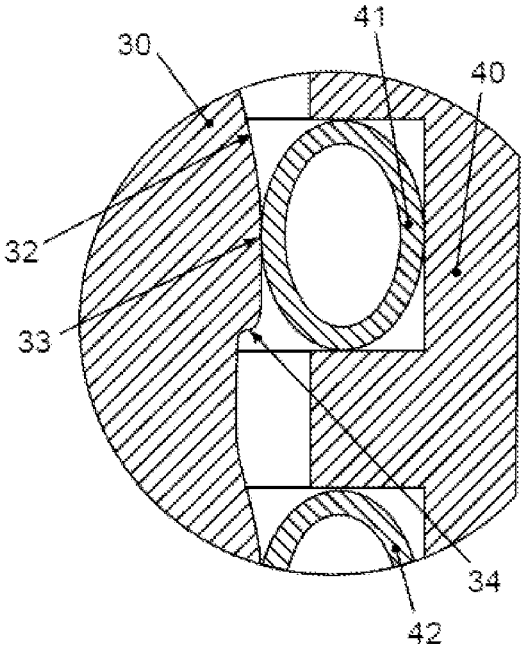
Figure 3:
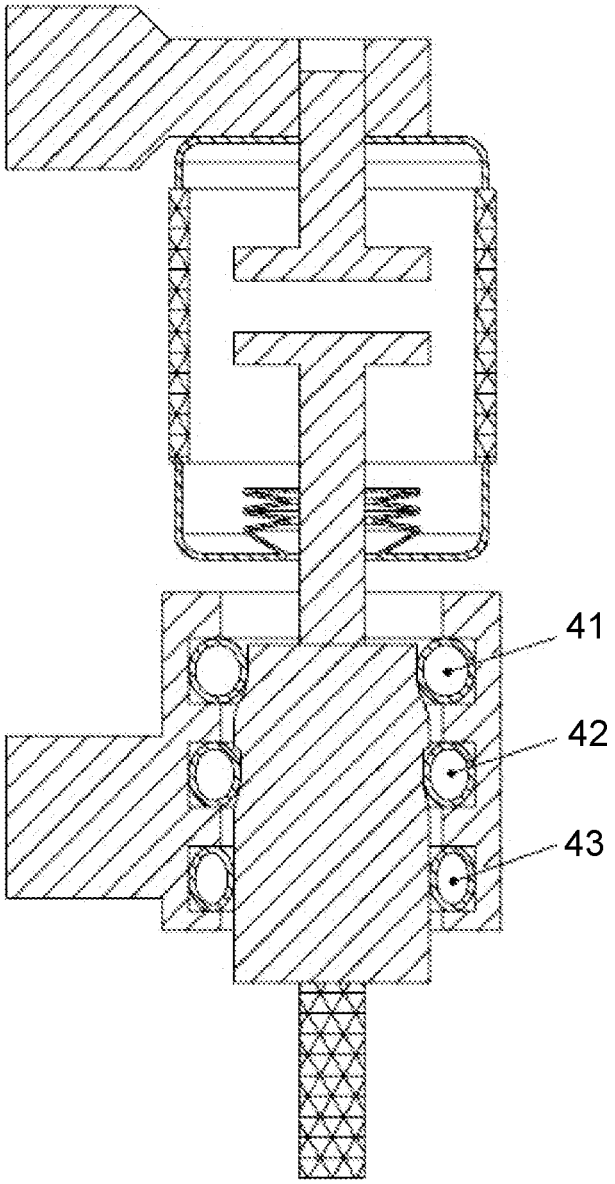
FIG. 3 shows a sectional view of an example of a medium voltage switching pole in an open configuration.

FIGS. 1-3 show examples of a medium voltage switching pole. The figures show electrical contacts located in a second or lower terminal 45 through which a piston 30 moves. However, these electrical contacts can be located in the piston 30 and move with the piston as it moves within the second or lower terminal 45. Also, there can be any number of electrical contacts, where three is shown just as a specific example.

These figures show a medium voltage switching pole 1. The medium voltage switching pole comprises a fixed contact 21 of a vacuum interrupter 20. The medium voltage switching pole 1 also comprises a movable contact 22 of the vacuum interrupter 20. The medium voltage switching pole 1 also comprises: a piston 30; at least one electrical contact 41, 42, 43; a first or upper terminal 10; and a second or lower terminal 45. The fixed contact 21 is fixedly connected to the first terminal 10. The movable contact 22 is fixedly connected to the piston 30. The piston 30 is configured to move within the second terminal 45 along an axis. The at least one electrical contact 41, 42, 43 is configured to make an electrical connection between the piston 30 and the second terminal 45. An outer surface of the piston and an inner surface of the second terminal are configured such that:

when in an open configuration the fixed contact and movable contact are separated from one another, wherein at least one first radial line perpendicular to the axis extends through locations of the at least one electrical contact and wherein a first distance along the at least one first radial line extends from the outer surface of the piston to the inner surface of the second terminal; and when in a closed configuration the fixed contact and movable contact are in contact with one another, wherein at least one second radial line perpendicular to the axis extends through locations of the at least one electrical contact and wherein a second distance along the at least one second radial line extends from the outer surface of the piston to the inner surface of the second terminal, and wherein the first distance is greater than the second distance.

According to an example, when in the open configuration the outer surface of the piston has a first diameter along the at least one first radial line. In other words, when in the open configuration as shown in FIG. 1 an axis perpendicular to the centre axis cuts through for example the electrical contact 41 on both sides of the piston 30. The diameter of the piston at this position is the first diameter. When in the closed configuration the outer surface of the piston has a second diameter along the at least one second radial line. In other words, when in the closed configuration as shown in FIG. 2 an axis perpendicular to the centre axis cuts through for example the electrical contact 41 on both sides of the piston 30. The diameter of the piston at this position is the second diameter, and the second diameter is greater than the first diameter. Thus, when the switching pole is in the closed state the electrical contact has a greater compressive force than when the switching pole is in the open state.

According to an example, at one or more first longitudinal positions the outer surface 31 of the piston has a circular cross section with a diameter of the first diameter. At one or more second longitudinal positions the outer surface 33 of the piston has a circular cross section with a diameter of the second diameter.

In an example, the second diameter is the same diameter for each of the one or more longitudinal positions.

In an example, the second diameter is a different diameter for each of the one or more longitudinal positions.

In an example, a second diameter at a first longitudinal position is less than a second diameter at a second longitudinal position further away from the movable contact 22 that the first longitudinal position.

According to an example, in a direction extending away from the second movable contact the outer surface 32 of the piston has a plurality of circular cross sections in transitioning from the outer surface 31 with the first diameter to the outer surface 33 with the second diameter.

According to an example, the plurality of cross sections form a cone shaped region.

According to an example, the plurality of cross sections form a sinusoidal shaped region.

According to an example, in a direction extending away from the second movable contact a transition region 34 joins the outer surface 33 with the second diameter to the outer surface 31 with the first diameter. When the switching open operates or transitions from the closed configuration to the open configuration the piston is configured such that the transition region 34 does not contact the at least one electrical contact.

According to an example, the at least one first radial line is at the same axial location as the at least one second radial line.

According to an example, the at least one electrical contact is fixed to the inner surface of the second terminal.

In an example, there is one electrical contact at a longitudinal position of the second terminal.

In an example, there are two electrical contacts at two longitudinal positions of the second terminal.

In an example, there are three electrical contacts at three longitudinal positions of the second terminal.

However, as discussed above the specific embodiments shown in FIGS. 1-2 are exemplar only, and the electrical contacts can be located different to that shown, and the relevant surfaces can be shaped differently.

Thus, in an example when in the open configuration the inner surface of the second terminal has a first diameter along the at least one first radial line. In other words, when in the open configuration as shown in FIG. 1 the electrical contact 41 could be located within the piston 30 rather than within the second terminal 45. Then an axis perpendicular to the centre axis cuts through for the electrical contact 41 on both sides of the piston 30. The inner diameter of the second terminal 45 at this position is the first diameter. When in the closed configuration the inner surface of the second terminal piston has a second diameter along the at least one second radial line. In other words, when in the closed configuration as shown in FIG. 2 again the electrical contact 41 could be located within the piston 30 rather than within the second terminal 45. Then an axis perpendicular to the centre axis cuts through for the electrical contact 41 on both sides of the piston 30. The inner diameter of the second terminal 45 at this position is the second diameter, and the second diameter is less than the first diameter. Thus, when the switching pole is in the closed state the electrical contact has a greater compressive force than when the switching pole is in the open state.

According to an example, at one or more first longitudinal positions the inner surface of the second terminal has a circular cross section with a diameter of the first diameter. At one or more second longitudinal positions the inner surface of the second terminal has a circular cross section with a diameter of the second diameter.

According to an example, in a direction extending away from the second movable contact the inner surface of the second terminal has a plurality of circular cross sections in transitioning from the inner surface with the first diameter to the inner surface with the second diameter.

According to an example, the plurality of cross sections form a cone shaped region.

According to an example, the plurality of cross sections form a sinusoidal shaped region.

According to an example, in a direction extending away from the second movable contact a transition region joins the inner surface with the second diameter to the inner surface with the first diameter. When the switching pole operates or transitions from the closed configuration to the open configuration the second terminal is configured such that the transition region does not contact the at least one electrical contact According to an example, the at least one first radial line is at a different axial location to the at least one second radial line.

According to an example, the at least one electrical contact is fixed to the outer surface of the piston.

In an example, there is one electrical contact at a longitudinal position of the piston.

In an example, there are two electrical contacts at two longitudinal positions of the piston.

In an example, there are three electrical contacts at three longitudinal positions of the piston.

According to an example, the at least one electrical contact is elastically deformable.

In an example, the at least one electrical contact is a spiral contact.

In an example, the at least one electrical contact is a multicontact.

Thus, as described above a dedicated profile on the surface that is running over the contact elements is provided and that results in the contact force be reduced in the open position of the switch with respect to the closed position.

Continuing with the figures, the medium voltage switching pole is now described in greater detail with respect to a specific embodiment, where the electrical contacts are located within the second or lower terminal.

FIG. 1 shows a sectional view of a MV switching pole 1. It is mainly consisting of an upper terminal 10, a vacuum interrupter (VI) 20, a piston 30, a hollow cylinder 40 with spiral contacts 41 to 43 and a lower terminal 45, with a connection 50 to a drive. A structure for mechanical support and for an improved electrical insulation, for example made of epoxy, is not shown here. Medium voltage (MV) can be insulated between the upper and lower terminals when the drive has locked the pole in the open positon, as shown in FIG. 1. A MV current can flow between the upper and the lower terminal when the drive has brought the pole in the closed position, as shown in FIG. 2.

In existing systems, the piston has a cylindrical surface. The diameter of this cylinder is chosen so that the contact pressure on the spiral contacts is the nominal pressure, i.e. the pressure is high enough to ensure a low electrical contact resistance to limit the losses and the temperature rise when the nominal rated current of the switching pole is flowing through the switching pole 1.

However, in the new design described here the piston has this diameter only in those regions that are actually touching the spiral contacts when the pole 1 is in the closed position, as shown in FIG. 2 with the region 33.

If the pole 1 is in the open position, as shown in FIG. 1, no current can flow, and therefore it is not required to expose the full nominal contact force to the spiral contacts. Therefore, the diameter of the piston 30 is reduced in those regions that are actually touching the spiral contacts when the pole 1 is in the open position, as shown in FIG. 1 with the region 31. For a smooth closing operation, these two regions 31 and 33 are connected with a transitional region 32, avoiding sharp edges that could scratch or damage the spiral contacts during the closing operation. The profile of the piston that is designed to touch a certain spiral contact comprises the regions 31, 32 and 33. In the example shown in the figures there are two regions 31 and 33 with constant diameter connected with a cone-shaped region 32. The edges between the regions are rounded with a constant radius. Other possible profiles are for example a sinusoidal profile, or the profile can include variable radii or the like. Several profiles on the piston 30 are linked with a transitional region 34. The MV switching pole 1, is designed through correct dimensioning to ensure that the region 34 does not touch the next lower spiral contact 42 in the open position. In the detailed view of FIG. 1, there is therefore a little vertical distance shown between 34 and 42 that exemplifies this. Further, through correct dimensioning a spiral contact cannot run along the full region 33 during the closing operation and cannot come to rest on the region 34 in the closed position. In the detailed view of FIG. 2, there is therefore some vertical distance shown between 34 and the touching area of 33 and 41 that exemplifies this. This distance is a margin for the mechanical compression and electrical wear of the fixed contact and the movable contact of the VI during its lifetime.

Due to this region 31 with a reduced diameter, the static friction at the start of the closing operation is reduced. This results in more even closing times, and also in more even closing speeds, especially when the drive of the pole cannot easily generate high closing forces in the open position, for example in the case for magnetic actuators.

Three spiral contacts are shown, however a different number of spiral contacts may be used, for example 1, 2 or 4, depending on other constraints of the application of the MV switching pole 1. The discussed profile may then be applied to all or to less than all the spiral contacts. The diameter 31 can also have different actual values for each of the spiral contacts for more flexible adjustment of the friction in the open position, as shown in the FIG. 3 for the opened position. For some but not for all of the spiral contacts the foreseen diameter 31 can be so small that the contact force in the open position is practically zero, as it is the case for the spiral contact 41 in FIG. 3. The spiral contact 42 in FIG. 3 has an intermediate value for the diameter 31, while the spiral contact 43 has no special profile at all, i.e. the diameter 31 of this spiral contact is the same as the diameter 33, which is the regular nominal diameter of the piston. It should be avoided that the contact force is zero for all spiral contacts in the open position, i.e. then there would be no galvanic contact between the lower terminal 45 and the movable contact 22. Due to capacitive coupling, the electrical potential of the movable contact can then reach uncontrolled values.

In other embodiments, multicontacts or combinations of spiral contacts and multicontacts may be used.

In other embodiments, as discussed above the contact elements can be fixed to the movable part instead of the fixed part. Then, the discussed profiles can be applied to the hollow cylinder to receive the same low forces at the start of the closing operation while keeping the nominal forces in the closed position.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE NUMERALS

1 MV switching pole
10 Upper or first terminal
20 Vacuum Interrupter
21 Fixed contact of 20
22 Movable contact of 20
23 Upper lid of 20
24 Insulator of 20
25 Lower lid of 20
26 Bellows of 20
30 Piston
31 Region of reduced diameter of 30
32 Transitional region from 31 to 33
33 Region of nominal diameter of 30
34 Transition from the profile for one spiral contact to the profile for the next spiral contact
40 Hollow cylinder with grooves for spiral contacts and with lower terminal
41 First spiral contact
42 Second spiral contact
43 Third spiral contact
45 Lower or second terminal
50 Mechanical connection to the drive of the pole

What is claimed is:

1. A medium voltage switching pole, comprising:
a fixed contact of a vacuum interrupter;
a movable contact of the vacuum interrupter;

a piston;

at least one electrical contact;

a first terminal; and a second terminal, wherein the fixed contact is fixedly connected to the first terminal, wherein the movable contact is fixedly connected to the piston, wherein the piston is configured to move within the second terminal along an axis, wherein the at least one electrical contact is configured to make an electrical connection between the piston and the second terminal, wherein the at least one electrical contact is fixed to an inner surface of the second terminal, wherein an outer surface of the piston and an inner surface of the second terminal are configured such that:

when in an open configuration the fixed contact and movable contact are separated from one another, at least one first radial line perpendicular to the axis extends through locations of the at least one electrical contact, and a first distance along the at least one first radial line extends from the outer surface of the piston to the inner surface of the second terminal, the outer surface of the piston having a first diameter along the at least one first radial line, and when in a closed configuration the fixed contact and movable contact are in contact with one another, at least one second radial line perpendicular to the axis extends through locations of the at least one electrical contact, and a second distance along the at least one second radial line extends from the outer surface of the piston to the inner surface of the second terminal, the outer surface of the piston having a second diameter along the at least one second radial line, the first distance being greater than the second distance, the second diameter being greater than the first diameter, wherein the at least one first radial line is at a same axial location as the at least one second radial line, wherein at one or more first longitudinal positions the outer surface of the piston has a circular cross section with a diameter of the first diameter, wherein at one or more second longitudinal positions the outer surface of the piston has a circular cross section with a diameter of the second diameter, wherein in a direction extending away from the movable contact a transition region joins the outer surface with the second diameter to the outer surface with the first diameter, and wherein when in transitioning from the closed configuration to the open configuration the piston is configured such that the transition region does not contact the at least one electrical contact.

2. The medium voltage switching pole of claim 1, wherein, in a direction extending away from the movable contact, the outer surface of the piston has a plurality of circular cross sections between the outer surface with the first diameter and the outer surface with the second diameter.

3. The medium voltage switching pole of claim 2, wherein the plurality of cross sections form a cone shaped region.

4. The medium voltage switching pole of claim 2, wherein the plurality of cross sections form a sinusoidal shaped region.

5. The medium voltage switching pole of claim 1, wherein at one or more first longitudinal positions the inner surface of the second terminal has a circular cross section with a diameter of the first diameter, and wherein at one or more second longitudinal positions the inner surface of the second terminal has a circular cross section with a diameter of the second diameter.

6. The medium voltage switching pole of claim 5, wherein in a direction extending away from the movable contact the inner surface of the second terminal has a plurality of circular cross sections between the inner surface with the first diameter and the inner surface with the second diameter.

7. The medium voltage switching pole of claim 6, wherein the plurality of cross sections form a cone shaped region.

8. The medium voltage switching pole of claim 6, wherein the plurality of cross sections form a sinusoidal shaped region.

9. The medium voltage switching pole of claim 5, wherein in a direction extending away from the movable contact a transition region joins the inner surface with the second diameter to the inner surface with the first diameter, and wherein when in transitioning from the closed configuration to the open configuration the second terminal is configured such that the transition region does not contact the at least one electrical contact.

10. The medium voltage switching pole of claim 1, wherein the at least one electrical contact is elastically deformable.

* * * * *